US005177922A

United States Patent [19]

Ovaert et al.

[11] Patent Number: 5,177,922

[45] Date of Patent: Jan. 12, 1993

[54] LEAKTIGHT COVERING FIXED TO A FRAMEWORK

[75] Inventors: Francis Ovaert, Paris; Henri Desgouilles, Chantilly, both of France

[73] Assignee: Axter, Saint-Quentin en Yvelines, France

[21] Appl. No.: 654,672

[22] Filed: Feb. 14, 1991

[30] Foreign Application Priority Data

Feb. 14, 1990 [FR] France ..... 90 01755

[51] Int. Cl.[5] ..... E04B 7/06

[52] U.S. Cl. ..... 52/410; 52/512; 411/383

[58] Field of Search ..... 52/408, 410, 512, 409, 52/412; 411/389, 383, 546, 338, 339

[56] References Cited

U.S. PATENT DOCUMENTS

| | | | |
|---|---|---|---|
| 4,453,361 | 6/1984 | Hulsey | 52/410 |
| 4,604,846 | 8/1986 | Ekström | 411/546 X |
| 4,651,490 | 3/1987 | Marston | 52/410 |
| 4,736,561 | 4/1988 | Lehr et al. | 52/410 |
| 4,787,775 | 11/1988 | Hammer | 52/410 X |
| 4,932,819 | 6/1990 | Almeras | 52/410 X |
| 4,934,887 | 6/1990 | Sharp et al. | 411/339 |
| 5,018,329 | 5/1991 | Hasan et al. | 52/410 |
| 5,033,242 | 6/1991 | Borbely et al. | 52/410 X |

FOREIGN PATENT DOCUMENTS

| | | | |
|---|---|---|---|
| 2803709 | 8/1979 | Fed. Rep. of Germany | 52/512 |
| 2838566 | 3/1980 | Fed. Rep. of Germany . | |
| 3040794 | 5/1981 | Fed. Rep. of Germany . | |
| 3515734 | 11/1986 | Fed. Rep. of Germany . | |
| 2553836 | 4/1985 | France . | |
| 2111115 | 6/1983 | United Kingdom . | |
| 2122234 | 1/1984 | United Kingdom . | |

*Primary Examiner*—David A. Scherbel
*Assistant Examiner*—Kien Nguyen
*Attorney, Agent, or Firm*—Wenderoth, Lind & Ponack

[57] ABSTRACT

A leaktight covering, in particular for an industrial building, includes a loadbearing element adapted to be fixed to a framework element of the building, a layer of an insulating material arranged on the loadbearing element, and a cladding covering the layer of insulating material, with connection structure holding such three components assembled together. A first member is used, on the one hand, to ensure fixing of the loadbearing element to the framework element and, on the other hand, forms part of the connection structure. A second member is linked to the first member and to the cladding. In a first embodiment, the first member is a screw screwed into the framework element, and the connection structure includes a hollow, cylindrical intermediate piece, a bottom of which is fixed to the loadbearing element via the screw.

11 Claims, 4 Drawing Sheets

LEAKTIGHT COVERING FIXED TO A FRAMEWORK

BACKGROUND OF THE INVENTION

The present invention relates to insulating and leaktight coverings, and in particular coverings for industrial buildings.

These coverings fixed to a framework comprise a thermal insulation between a loadbearing element and a cladding. This insulation is principally realized by plates or panels laid touching one another. These plates are fastened firmly to the loadbearing element by a mechanical fixing means when a support consists of profiled steel sheets.

The mechanical fixing means consists of a screw, or a rivet or a bolt fastened firmly to the profiled steel sheet by drilling or by welding. At its upper part, a head of the screw, rivet or bolt has a washer of small dimensions, of a diameter of the order of 50 to 70 mm.

The cladding is fastened firmly to the insulating plates by adhesive bonding or by welding using a heat source, usually with a flame or air torch, over the entire surface of the insulating panels and/or at the level of the washers of the mechanical fixing means. The latter can be improved for welding by an appropriate surface coating or by a washer made from the same material as the cladding, and of larger dimensions, placed in between the metal washer and the underlying insulating panel.

A more recent technique provides for a first bed of foils constituting the lower part of the cladding to be unwound dry over the insulating panels. The mechanical fixing means then traverse the foil bed and the insulating panels. In the case of panels sensitive to the flame of a torch, a prior heat screen can be employed on the insulator. The upper part of the cladding is then adhesively bonded or welded to the lower part comprising its visible washers.

Another technique provides mechanical fixing means at the level of lap joints of the widths of the cladding. A lapped part is adhesively bonded or welded, on the one hand, to the edge of the adjacent width and, on the other hand, to the small washers of the fixing means.

The wind creates considerable localized compression and suction forces on the covering (vortices, shielding effect behind a wall or a salient part of the roofing). The forces are exerted on the outer surface and hence on the cladding, which ultimately stresses the loadbearing element and the structure of the building.

In the area lying between the cladding and the loadbearing element, these forces create, at the level of one or more fixing means, tear-away forces perpendicular and parallel to the covering surface. These latter forces are more substantial the greater the spacing between the fixing devices. They can result in the cladding ripping at the head of the fixing means and/or the fixing means being torn away at the level of their connection to the framework or the loadbearing element under a torque or traction effect.

For these two latter techniques, at least one sheet of the cladding is pierced by the mechanical fixing means.

In all cases, in order to resist the suction forces created by the wind, the French standards defined within the D.T.U. 43.3 and common practice provide for a minimum of five fixing means per $m^2$ of roofing, based on the fact that a fixing means resists a tear-away force of approximately 900N.

A rupture occurs at the level of the plane of the adhesive bonding of the cladding to the washer, or as a result of the head of the fixing means becoming dislodged and passing through the washer, or as a result of the fixing means being torn away through the profiled steel sheet. The values of the rupture are relatively homogeneous, of the order of 900 to 1300N.

The large number of fixing means makes implementation lengthy and expensive. Furthermore, the performance of the cladding is considerably diminished at the level of the fixing means because the cladding is partially pierced, or because it can be punched by the head of the fixing means passing through the washer, or alternatively torn at the periphery of the washer when the latter is locked, redundantly, on the rod of the, fixing means, as described in French Patent 1,522,378. Such phenomenon favors the breaking of the weld between the bolt and the profiled steel sheet. These disadvantages are considerably amplified when the insulating panels are compressible but elastic.

SUMMARY OF THE INVENTION

The object of the present invention is to provide a covering which is simpler and quicker to implement than the conventional openings covering and, moreover, which has an improved resistance to wind.

To this end, the invention provides a leaktight covering, in particular for an industrial building, comprising a loadbearing element adapted to be fixed to a framework element of the building, a layer of an insulating material arranged on the loadbearing element, and a cladding covering the layer of insulating material, connection means being provided in order to maintain such three components assembled together. The connection means comprise a first fixing member fixing the loadbearing element to the framework and comprising, above the loadbearing element, an extension piece of a length substantially equal to the thickness of the insulating layer and a flexible plate and a second fixing member bearing on such flexible plate via a widened head and/or a rigid washer and fixed to the extension piece. The dimension of the widened head or of the rigid washer is between the maximum dimension of the first or the second member in the vicinity of the outer surface of the layer of insulating material and the dimension of the flexible plate. The cladding is fixed only to the flexible plates.

In this manner, the cladding which will be fixed to a number of flexible plates will be fastened firmly to the framework moreover, the invention also makes it possible to fasten the loadbearing element firmly to the framework in such a way that all the suction forces to which the covering is subjected will be transmitted to the framework element, purlin or beam.

This high-performance device permits the use of at most one fixing means per $m^2$ of covering (or even one per 2 $m^2$), thus dividing the total number of fixing means by more than five as compared with the conventional techniques described above.

In the case of a steel framework, the above-mentioned screw can be a self-tapping screw. In the case of a concrete framework, the abovementioned screw is engaged in a metal insert of the framework element.

BRIEF DESCRIPTION OF THE INVENTION

Other features and advantages of the invention will become apparent from the description which follows of illustrative embodiments of the invention, made with reference to the attached drawings, in which.

DETAILED DESCRIPTION OF THE INVENTION

Figure 1:
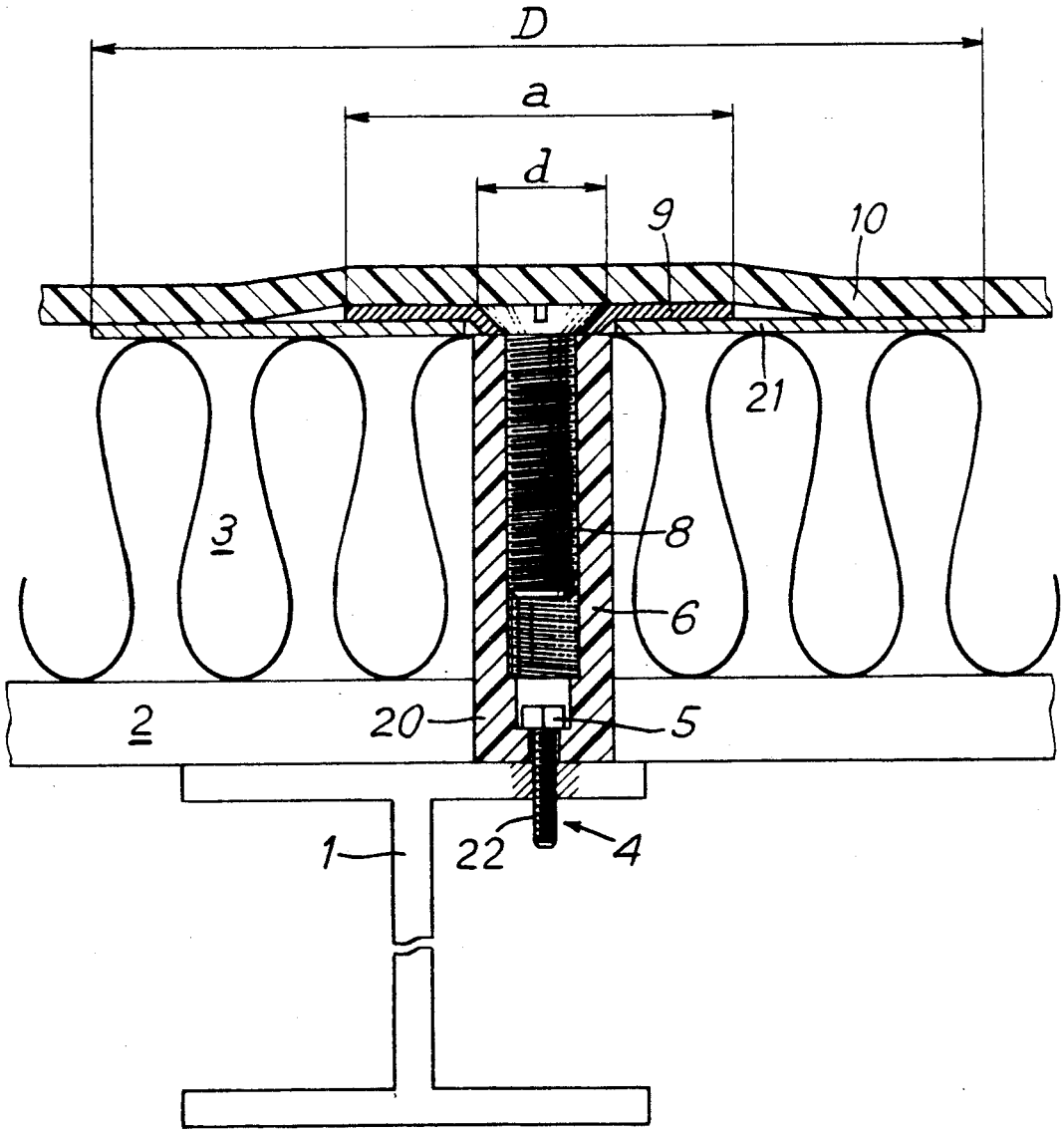
FIG. 1 is a diagrammatic sectional representation of a first embodiment of the invention.
Figure 2:
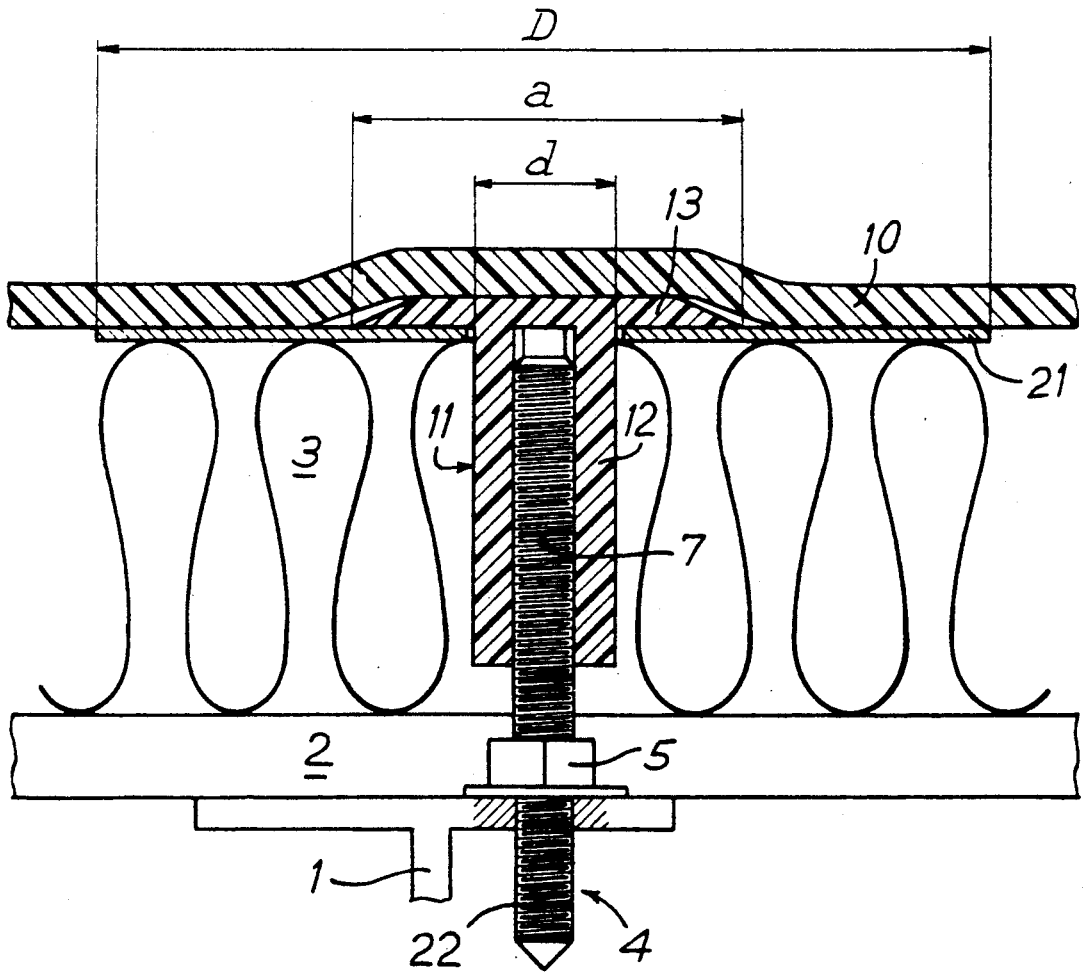
FIG. 2 is a diagrammatic sectional representation of a second embodiment of the invention.

A framework element can be seen in FIGS. 1 and 2 would consists of a steel joist 1 constituting a purlin of a framework. A loadbearing element 2 consisting of a profiled steel sheet is arranged transversely on purlins 1.

An insulating layer 3 consisting, for example, of plates of insulating material is placed on the load-bearing element 2. The covering or roofing is completed by a cladding 10 which is placed on the outer face of the insulating layer 3.

A fixing device according to the invention comprises a first fixed member comprising a screw 4 which is fixed to the purlin 1 with interposition of the support element 2 which is therefore in this way firmly fastened to the framework.

This first member serves firstly to fix the loadbearing element 2 to the framework purlin 1, and also constitutes an element forming part of a connection means for the three components of the covering, namely the load-bearing element 2, the insulating layer 3 and the cladding 10.

The screw 4 is advantageously a self-tapping screw. In the case of a concrete framework, screw 4 engages in a metal insert of the framework element.

A head 5 of the screw 4 has an extension piece aligned with the shaft of the screw and arranged on the opposite side of the head 5. In the first embodiment of FIG. 1, this extension piece consists of an internally threaded, hollow, cylindrical intermediate piece 6 which is open at its free end and a bottom 20 of which is fixed to the loadbearing element via the screw 4. In the embodiment in FIG. 2, the extension piece consists of a threaded rod 7. The length of the cylinder 6 or of the rod 7 is substantially equal to the sum of the thicknesses of the insulating layer 3 and of the loadbearing element 2.

A second member comprising a part including a rigid washer is fastened firmly to the abovementioned first member. In the case of FIG. 1, this second member is a screw 8 which engages in the cylinder 6, which has a milled flat head and on which is engaged a rigid washer 9 of diameter and forming a rigid distribution element.

In the embodiment in FIG. 2, the second member consists of a sort of plug 11 which has an internally threaded tubular part 12 which interacts with the rod 7 and which is surmounted by a rigid flat head 13 constituting a bearing washer or rigid distribution element similar to the rigid washer 9.

Lastly, the fixing device comprises a flexible plate 21 which is placed between the rigid washer 9 or the rigid flat head 13 and the insulating panels 3. Plate 21 is preferably circular, of diameter D and of large dimensions.

Flexible plate 21 is, for example, made from a metal of small thickness and can comprise a surface coating compatible with the material constituting the cladding. It is also possible to use a material comprising a reinforcement which is woven or nonwoven, made from glass, polyester, organic material or from a mixture of these components, in which case the plate is coated with a material identical to or compatible with that of the cladding.

The abovementioned plate 21 can advantageously be fastened beforehand firmly to the washer 9 or to the rigid head 13 by adhesive bonding or welding.

In the embodiment in FIG. 1 comprising a first member consisting of a screw, it is also possible to provide for the flexible plate to be crimped between two rigid washers corresponding to the washer 9.

The rigid washer 9 or the flat head 13 can have a diameter a of the order of 80 mm.

The flexible plate 21 must have a mechanical strength under tension which conforms with the equation $R_t \pi a > 5000N$ and preferably of the order of 8000N, the mechanical strength under tension $R_t$ being expressed in Newtons per cm width and measured in accordance with the standard NF G07—001. Plate 21 must also have a tear strength Rd (measured in accordance with the UEATC method 5.4.1., July 1982) which is at least equal to 200N and preferably of the order of 400N. To this end, the diameter d of the cylindrical piece 6 in the embodiment in FIG. 1, or of the second member 11 in the embodiment in FIG. 2, in the vicinity of the outer surface of the layer 3 of insulating material, must be not less than 6 mm and preferably of the order of 10 mm.

Moreover, the difference between the diameter D of the plate 21 and the diameter a of the rigid washer 9 or of the flat head 13 must be at least equal to 100 mm and preferably of the order of 170 mm. As a result, it is possible to use, for example, a flexible plate whose diameter D is of the order of 250 mm.

The diameter of the washer or rigid head a and the diameter d of the fixing element are advantageously selected in such a way that the difference $(a-d)$ is approximately equal to 90 mm and in any case greater than 70 mm. This makes it possible to prevent the flexible plate 21 from allowing the rigid piece 9 or 13 to "escape" by slipping, tearing or becoming dislodged.

Figure 3:
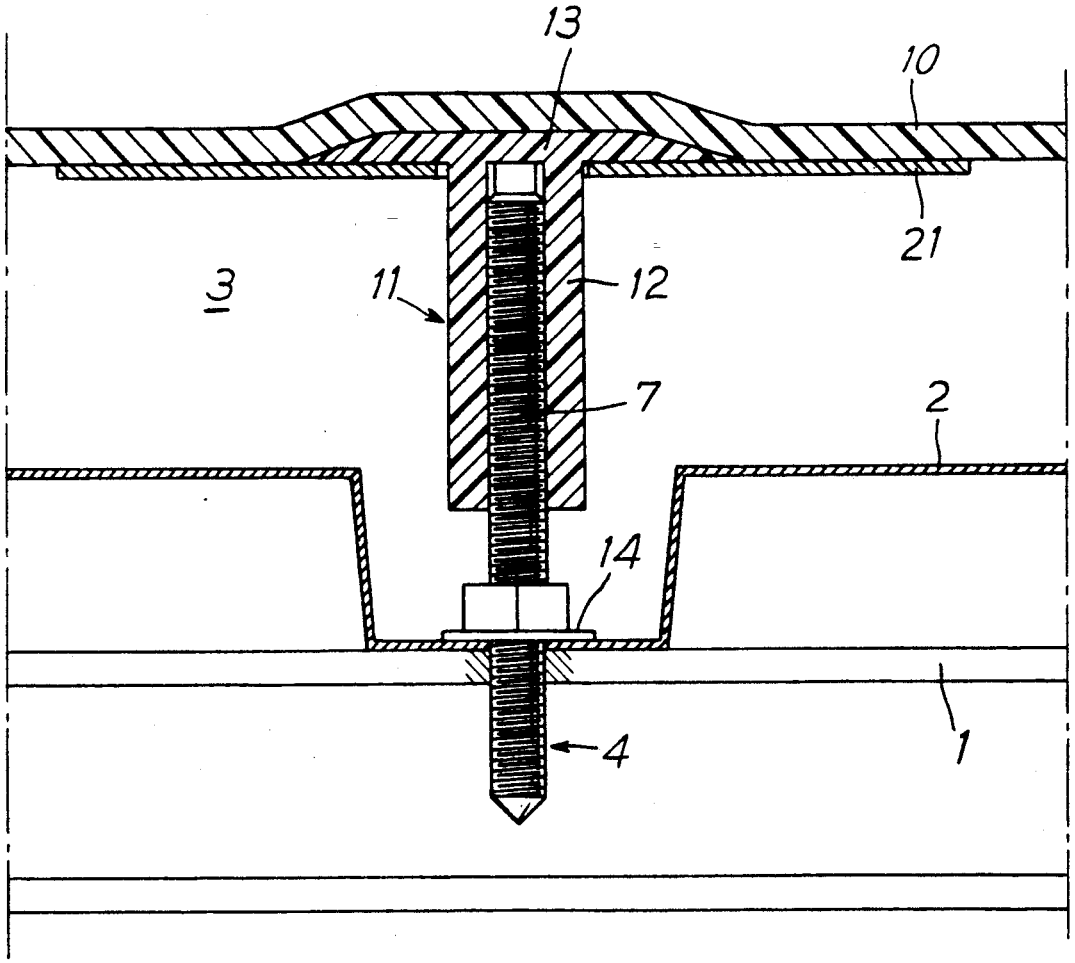
FIG. 3 is a view in section along a framework element and corresponds to the embodiment in FIG. 2.

FIG. 3 is a view in section perpendicular to FIG. 2 and shows the method of fixing the loadbearing element 2 to the purlin 1. It can be seen that the rod 7 is integrally connected to the head of the self-tapping screw 4 which is fixed in a recess of the profiled sheet 2 on the purlin 1 with the interposition of a washer 14.

The fixing device according to the invention advantageously comprises at least one thermally insulating element in order to prevent the formation of thermal bridges.

Figure 4:
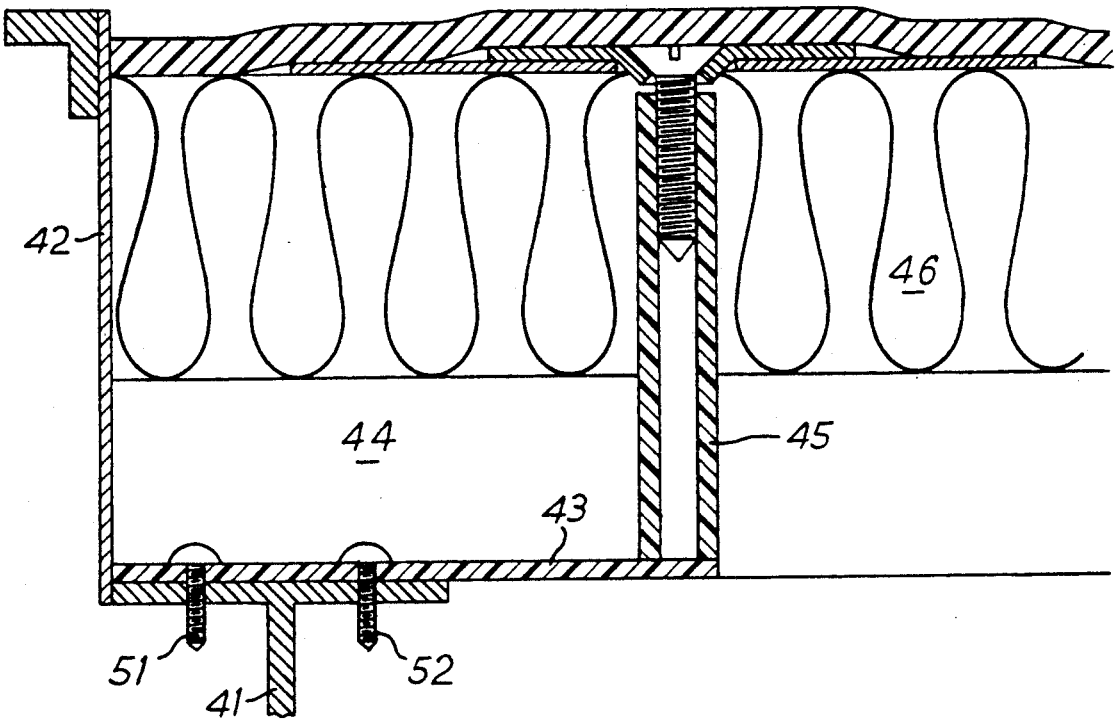
FIGS. 4 and 5 are sectional views illustrating a particular embodiment of the invention.
Figure 5:
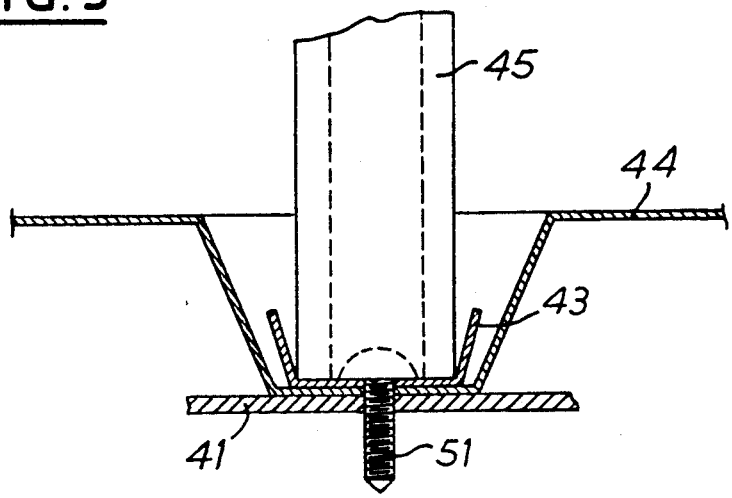

FIGS. 4 and 5 show an alternative embodiment of the invention. This is intended in particular for edge purlins 41 which are directly adjacent to an acroterium or ornamental summit 42.

In this case, the axis of the fixing point of the cladding is offset relative to the axis of fixing of the loadbearing element to the purlin. To this end, the first member consists of two screws 51 and 52 arranged symmetrically relative to the axis of a purlin 41 which constitutes the axis of fixing of a profiled sheet 44 to the purlin 41.

Screws 51, 52 serve to fix one end of a base 43 to the purlin 41. Base 43 preferably has, in cross-section (FIG. 5), the shape of a U and carries, at one of its ends, a hollow cylindrical member 45 similar to the cylindrical piece 6 in FIG. 1.

It can be seen that the axis of the hollow member 45 is offset relative to the axis of the purlin 41. It is, of course, possible to provide a similar arrangement in which the base 43 supports a rod similar to the rod 7 in FIG. 2.

A covering in accordance with the present invention can be realized as follows. Firstly, the loadbearing element 2, 44 (profiled sheet) is fixed to the beams or purlins 1, 41 of the framework by means of the fixed members 4 or 51, 52. The panels of the insulating layer 3, 46 are positioned by "impaling" them on the extension pieces 6 and 7 respectively of the first members. The flexible plates are positioned where they are not firmly fastened to the rigid washers, and then the fixing of the second members 8, 11 to the first members is carried out so as to fasten the second members firmly to the loadbearing element and the purlin or beam. Then the cladding is positioned and is fixed by welding or adhesive bonding to the flexible plate and the rigid washer of the devices according to the invention.

The various mechanical elements (self-tapping screw, first member, second member) are dimensioned so as to have a tear strength of the order of 5000N. In this way a homogeneous assembly is obtained which has a tear strength of 5000N, and all of the forces resulting from a suction exerted on the cladding are transmitted directly to the framework by the fixing members.

Since the number of fixing means per $m^2$ is very considerably reduced, the cost and the time taken to install a covering are considerably reduced, which makes it possible to construct coverings with large surface areas, in particular coverings for industrial buildings.

Furthermore, in the event of people moving about on the covering or of compressive loads, the cladding follows the movements of the flexible plate and cannot therefore be torn at the level of the periphery of the rigid washer. Highly compressible insulators can be used for the insulating layer, which makes it possible to reduce further the cost and this is particularly so in the case where the flexible plate is crimped between two rigid washers.

It is possible, for example, to use mineral wool having a density of less than 120 $kg/m^3$ and preferably equal to 100 $kg/m^3$ instead of mineral wool of a density of 150 $kg/m^3$ which is currently used.

It is also possible to use glass wool with a density of less than 90 $kg/m^3$ instead and in place of a glass wool of a density of 110 $kg/m^3$.

We claim:

1. A leaklight covering, particularly for an industrial building, comprising:

a metal sheet loadbearing element adapted to be fixed to a framework element of the building;

a layer of insulating material arranged on and above said loadbearing element;

a watertight cladding covering said layer of insulating material;

a plurality of connection means for maintaining said loadbearing element, said layer of insulating material and said cladding assembled together, each said connection means comprising:

a first fixing member for fixing said loadbearing element to the framework element, said first fixing member including, above said loadbearing element, an elongated extension piece extending upwardly substantially to an upper surface of said layer of insulating material;

a flexible plate positioned on said upper surface of said layer of insulating material;

a second fixing member fixed to said extension piece and having a rigid distribution element bearing on said flexible plate; and said rigid distribution element having a dimension in a direction perpendicular to said extension piece between a maximum dimension in said direction of said first or second fixing member in the vicinity of said upper surface of said layer of insulating material and a dimension in said direction of said flexible plate;

said flexible plates of said plurality of connection means being spaced from one another; and said cladding being bonded only to said flexible plates and to said distribution elements of said plurality of connection means.

2. A covering according to claim 1, wherein said rigid distribution element comprises a widened head of said second fixing member.

3. A covering according to claim 2, wherein said flexible plate is fastened firmly to said rigid distribution element.

4. A covering according to claim 1, wherein said rigid distribution element comprises a rigid washer.

5. A covering according to claim 1, wherein said first member further includes a screw to be screwed into the framework element, and said elongated extension piece comprises a hollow, cylindrical intermediate piece having a bottom which is fixed to said loadbearing element by said screw.

6. A covering according to claim 1. wherein said first member further includes a screw having a shaft to be screwed into the framework element and having a head, and said elongated extension piece comprises a rod extending upwardly from said head opposite said shaft of said screw.

7. A covering according to claim 1, wherein said elongated extension piece has an axis which is offset relative to an axis of fixing of said loadbearing element to the framework element.

8. A covering according to claim 1, wherein, if a designates a diameter of said rigid distribution element, d a diameter of said first fixing member or of said second fixing member in said vicinity of said upper surface of said layer of insulating material, D a diameter of said flexible plate, and Rt a mechanical strength under tension of said flexible plate, the following conditions exist:

$$Rt\pi a \geqq 5000\text{N}$$

$$a-d \geqq 70 \text{ mm}$$

$$D-a \geqq 100 \text{ mm}$$

9. A covering according to claim 1, wherein said flexible plate has a tear strength Rd greater than or equal to 200N, and a diameter d of said first fixing member or of said second fixing member in said vicinity of said upper surface of said layer of insulating material is at least equal to 6 mm.

10. A covering according to claim 1, wherein fixing of said second fixing member to said first fixing member is effected by means selected from the group comprising screwing, clip-fastening or bayonet fixing means.

11. A covering according to claim 1, wherein said layer of insulating material consists of mineral wool having a density less than 120 $kg/m^3$ or of glass wool having a density less than 90 $kg/m^3$.

* * * * *